US006843868B1

(12) United States Patent
Fawls et al.

(10) Patent No.: US 6,843,868 B1
(45) Date of Patent: Jan. 18, 2005

(54) PROPELLANTS AND EXPLOSIVES WITH FLOURO-ORGANIC ADDITIVES TO IMPROVE ENERGY RELEASE EFFICIENCY

(75) Inventors: Christopher J. Fawls, Charlotte Hall, MD (US); Joel P. Fields, Charlotte Hall, MD (US); Kerry L. Wagaman, Bryantown, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/691,220

(22) Filed: Oct. 23, 2003

(51) Int. Cl.[7] ..... C06B 45/10; C06B 43/00
(52) U.S. Cl. ..... 149/19.3; 149/22
(58) Field of Search ..... 149/19.3, 22

(56) References Cited

U.S. PATENT DOCUMENTS

| | | | | |
|---|---|---|---|---|
| 3,266,958 | A | | 8/1966 | Breazeale et al. ..... 149/19 |
| 3,362,860 | A | | 1/1968 | D'Aleio ..... 149/19 |
| 3,865,658 | A | | 2/1975 | Flynn ..... 149/19.3 |
| 3,967,989 | A | | 7/1976 | Hawthorne ..... 149/19.2 |
| 4,017,342 | A | | 4/1977 | Geisler et al. ..... 149/5 |
| 4,634,479 | A | | 1/1987 | Buford ..... 149/6 |
| 4,758,288 | A | | 7/1988 | Versic ..... 149/6 |
| 5,030,301 | A | | 7/1991 | Stout et al. ..... 149/5 |
| 5,175,022 | A | | 12/1992 | Stout et al. ..... 427/561 |
| 5,565,710 | A | * | 10/1996 | Ochi et al. ..... 264/3.4 |
| 5,714,711 | A | | 2/1998 | Schumacher et al. ..... 102/291 |
| 5,717,159 | A | * | 2/1998 | Dixon et al. ..... 149/40 |
| 5,798,480 | A | | 8/1998 | Willer et al. ..... 149/19.4 |
| 5,811,725 | A | | 9/1998 | Klager ..... 149/19.4 |
| 5,912,069 | A | | 6/1999 | Yializis et al. ..... 428/213 |
| 6,132,536 | A | * | 10/2000 | Hohmann et al. ..... 149/19.92 |
| 6,197,135 | B1 | | 3/2001 | Monte et al. ..... 149/19.2 |
| 6,425,966 | B1 | | 7/2002 | Highsmith et al. ..... 149/19.1 |
| 6,454,886 | B1 | | 9/2002 | Martin et al. ..... 149/2 |

* cited by examiner

*Primary Examiner*—Aileen Felton
(74) *Attorney, Agent, or Firm*—Mark Homer

(57) ABSTRACT

A non-/low-toxic, non-hypergolic, propellant formulation generally comprising metal nanoparticles, such as boron, aluminum, or carbon, and one or more fluoro-polymers mixed in in particulate form. The present invention takes advantage of the increased surface area provided by nano-sized metallic particles to enhance the metal's combustion efficiency, or ignitability. The inclusion of fluoro-polymers also aids in increasing the combustion efficiency of the metallic nanoparticles due to the presence of halogenic oxidizers. The thermal degradation of a halogenated fluoro-polymer additive in the propellant combustion zone serves to release halogens, thereby improving the combustion of the metallic nanoparticles and increasing the propulsion system's energy output. The present invention's formulation is safe to store and handle, environmentally-friendly, and may be economically manufactured to provide for widespread, cost-effective use.

7 Claims, No Drawings

PROPELLANTS AND EXPLOSIVES WITH FLOURO-ORGANIC ADDITIVES TO IMPROVE ENERGY RELEASE EFFICIENCY

BACKGROUND OF THE INVENTION

1. Field of the Invention

The present invention relates to propellants and explosives used in rocket propulsion and in explosive munitions systems and, more particularly, to metallic nano-particle-based propellants and explosives formulations containing fluoro-organo chemical compounds solids to improve the propellant's and explosive's and explosive's energy release efficiencies 2. Description of the Background Current solid rocket propulsion munitions systems and explosive munitions systems typically contain solid energetic ingredients and lower amounts of inert binders and other chemical ingredients, preferably with fuel-additives for increased energy release. The present inventors are not the first to address the need for more efficient rocket propulsion systems, propellants and explosives. For example, U.S. Pat. Nos. 6,454,886 to Martin et al. and 5,912,069 to Yializis et al. acknowledge the utility of extremely small-sized particulate matter in the context of propellants.

Metallic additives are also well-known. For example, the Martin et al. '886 patent discloses the preparation of an aluminum nanoparticle matrix and Yializis et al. '069 includes the fabrication of metal/polymer nanolaminates. However, during the typical combustion of metal ingredients with oxygen atoms or oxygen gas, a metal oxide shell forms on the surface of the metallic particles and this inhibits the further oxidation of the metal underneath this metallic oxide, thereby reducing the overall available energy from a totally-oxidized metal.

The prior art also addresses the desirability of preventing the formation of the oxide barrier/coating of metallics with the resulting energy losses from this further oxidation by the surface oxide coating. Typically, previous concepts rely on:

1. fluorine sources such as gaseous fluorine; or
2. BF3 or inorganic fluorides; or
3. surface coating of the metallic fuel with a fluoro-polymer.

For example, the inclusion of polymer additives to assist in boosting the available energy of a propellant, or to improve combustion efficiency, is disclosed U.S. Pat. Nos. 6,197,135 to Monte et al., 5,811,725 to Klager, 4,758,288 to Versic, 3,865,658 to Flynn, and 3,266,958 to Breazeale et al. The additives include polybutadiene (Monte et al.), polymeric azo compounds (Klager), parylene (Versic), a copolymer of formaldehyde and perfluoroguanidine (Flynn), and polybutadiene (Breazeale et al.). Moreover, fluoro-polymer additives are found in U.S. Pat. Nos. 5,175,022 to Stout et al. (polytetrafluoroethylene) and 4,634,479 to Buford (polytetrafluoroethylene). Finally, recent studies conducted at Penn State University have indicated that the addition of a coating of Viton® aluminum particles present in a propellant mixture improves the combustion efficiency of the aluminum and the overall energy output of the propellant. Unfortunately, each of these prior art devices possesses certain limitations, especially when nano-particulate metallics are the fuel used. Coatings, especially of nano-metallic particulates, are able to add less than 1% fluor-compounds as coatings for the purpose of improving the physical/chemical/mechanical characteristics of these formulations, not for increased energy release efficiencies.

The concepts of thermobarics is a relatively recent development and researchers have not previously envisioned the benefits of using fluoro-additions in preventing the oxide inhibitions of poly-metallic chemical interactions. Therefore, there remains a need for propellants that provide an additional amount of utility in the operation of rocket propulsion systems. Materials of this type should burn completely in a predictable and controllable manner, and be non-hypergolic to provide for safe storage and handling, non-toxic or low in toxicity to enhance environmental friendliness, and be economical to manufacture in order to provide for widespread, cost-effective use.

SUMMARY OF THE INVENTION

It is, therefore, the primary object of the present invention to provide improved propellants for use in rocket propulsion systems, munitions, bioremediation and the like.

It is another object of the present invention to provide improved propellants that contain metallic nanoparticles with ingredient additions of fluoro-organo chemical compounds or fluoro-polymers as micro-beads, nano-particles and other larger sized fluoro-additives (versus the prior arts concepts which use gaseous fluoro chemical compounds or unsuccessfully coat the metallic fuels with fluoro polymers).

Yet another object of the present invention is to provide improved propellants that exhibit increased combustion efficiencies due to the presence of fluoro-polymers.

It is another object of the present invention to provide improved propellants that are non-toxic or low in toxicity.

It is still another object of the present invention to provide improved propellants that are non-hypergolic.

Still another object of the present invention is to provide improved propellants that are economical to manufacture to provide for widespread, cost-effective use.

These and other objects are accomplished by a non-/low-toxic, non-hypergolic, propellant formulation generally comprising metal nanoparticles, such as boron, aluminum, or carbon, and one or more fluoro-organo chemical compounds or fluoro-polymers (such as Teflon®, Viton®, or some other halogenated fluoro-polymer additive) added as solid particulates such as micro-beads, nano-particles, powder or other larger sized fluoro-additive form. The present invention makes advantageous use of the increased surface area provided by nano-sized metallic particles (in relation to the total volume of the nanoparticles) to enhance the metal's combustion efficiency, or ignitability due to the presence of halogenic oxidizers. The fluoro-chemical species is locally either pyrolytically- or chemically degraded in the combustion zone or in the explosive zone or in the thermobarics chemical interaction zone. The thermal degradation of the fluoro-polymer additive, in the propellant combustion zone, serves to release halogens, thereby improving the combustion of the metallic nanoparticles and increasing the propulsion system's energy output. Moreover, the fluoro-chemical compounds/atoms prevent the formation of the chemically-inhibiting coating of oxides on the metallic fuels by forming a metallic fluoride intermediate which does not inhibit the further oxidation to the final desired product, metallic oxide. Thereby, increasing the over-all energy released.

In the case of the metal—metal interactions, such as in thermobarics, the presence of the fluorine atoms will improve the efficiency of this metal—metal chemical interaction. In addition, residual bi-metallics or partially-oxidized or fluoride coated metallic surface will be more readily oxidized to their higher energy released state of a metallic oxide end-product.

The present invention's formulation is safe to store and handle, environmentally-friendly, and may be economically manufactured to provide for widespread, cost-effective use.

DETAILED DESCRIPTION OF THE PREFERRED EMBODIMENTS

The present invention is a non-/low-toxic, non-hypergolic, high performance propellant for use in rocket propulsion systems or explosive munition or themobaric munitions.

The propellant generally comprises conventional metal nanoparticles, such as boron, aluminum, or carbon and, in accordance with the present invention, the addition of fluoro-organo chemical compounds or fluoro-polymers as micro-beads, nano-particles, powder or other larger sized fluoro-additive formats (as opposed to the prior arts concepts of using gaseous fluoro chemical compound or coating the metallic fuels with fluoro polymers). Any poly-metallic standard propellant, explosive, including FAEs (fuel-air explosives, and thermobaric formulation may be used. Existing poly-metallic-containing propellant, explosive, pyrotechnic, themobaric and or FAE (fuel-air explosives) formulations generally comprises 0 to 50%-metallic nano-particles and larger poly-metallics. The selected propellant may be in the form of a solid, gel, a liquid, or some combination thereof (ie. a "hybrid" configuration).

In accordance with the present invention, 1 to 98% fluoro-additives are mixed in. The present inventors have found that a larger range of approximately 50–98% of fluoro-organo-compounds are desired for thermobaric and bio-remediation applications, and for propellant and explosive applications. The fluoro-additives may be any fluoro-organo and/or fluoro polymeric compound, such as poly-fluoro-benzene, vitons, Teflon, etc. The fluoro-additives is initially provided in solid particulate format, such as micro-beads, nano-particles, powder or other larger sized fluoro-additive formats. The fluoro-additive(s) is mixed in with the propellant using conventional mixing processes. Upon combustion, in the case of the metal—metal interactions, such as in thermobarics, the presence of the fluorine atoms will improve the efficiency of this metal—metal chemical interaction. In addition, residual bimetallic or partially-oxidized or fluoride coated metallic surface will be more readily oxidized to their higher energy released state of a metallic oxide end-product.

The following is a specific example.

EXAMPLE 1

A poly-metallic-containing propellant containing 50% by weight boron nano-particles may be utilized. Teflon® powder is mixed in the amount of 5% by weight of the overall propellant formulation. The inclusion Teflon® powder assists in increasing the combustion efficiency of the metallic nanoparticles due to the presence of halogenic oxidizers. The thermal degradation of Teflon®(E in the propellant combustion zone serves to release halogens, thereby optimizing the combustion of the metallic nanoparticles and the propulsion system's energy output. Moreover, as described in the background section, a metal oxide shell would otherwise form on the surface of the metallic particles and would inhibit the further oxidation of the metal underneath this metallic oxide coating, thereby reducing the overall available energy from the totally-oxidized metal. Upon combustion, Teflon® powder is locally either pyrolytically- or chemically degraded in the combustion zone and forms a metallic fluoride intermediate which prevents the formation of this chemically-inhibiting coating of oxides on the metallic fuels. The intermediate does not inhibit the further oxidation to the final desired product, metallic oxide, and thus increases the over-all energy released.

It should be understood that any existing poly-metallic-containing propellant, explosive, pyrotechnic, themobaric or FAE (fuel-air explosives) formulation may be used which generally comprises 0 to 50%-metallic nano-particles and larger poly-metallics. Otto fuel II, NOSET A, or a hydrocarbon could be used as a replacement for the EAN-AN based fuel or a polymeric binder in a hybrid fuel grain as the fuel. The selected propellant may be in the form of a solid, gel, a liquid, or some combination thereof (ie. a "hybrid" configuration). The fluoro-additives may be any fluoro-organo and/or fluoro polymeric compound, such as poly-fluoro-benzene, vitons, Teflon, etc. Further alternative embodiments of the present invention may include other halogen-containing polymers such as chloro-polymers. The fluoro-additives (or halogen-containing polymers) may be provided in any solid particulate format, such as micro-beads, nano-particles, powder or other larger sized fluoro-additive formats. Additionally, energetic ingredients such as HMX, RDX, or other energetic ingredients may be added to the fuel or hybrid grain to improve the energy output of these propellants.

As is readily perceived in the foregoing description, the propellant formulation of the present invention provides for improved combustion efficiency, thereby extracting the maximum amount of energy available. The present invention is safe to store and handle, environmentally-friendly, and may be economically manufactured to provide for widespread, cost-effective use.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

We claim:

1. An improved poly-metallic energetic formulation, the original poly-metallic energetic formulation having a fuel comprising metallic nanoparticles, wherein the improvement comprises:

a solid particulate fluoro-organo or fluoro polymeric compound mixed into said original poly-metallic energetic formulation in an amount ranging from approximately 1 to 98 weight percent of the improved poly-metallic energetic formulation;

wherein during combustion of the improved poly-metallic energetic formulation a metallic fluoride intermediate is formed on the fuel and halogens are released to improve combustion efficiency of the improved poly-metallic energetic formulation over the original poly-metallic energetic formulation.

2. The improved formulation according to claim 1 wherein said fuel comprises boron.

3. The composition according to claim 1 wherein said fuel comprises aluminum.

4. The composition according to claim 1 wherein said fuel comprise carbon.

5. The composition according to claim 1 wherein said fluoro-polymer comprises a powder.

6. The composition according to claim 1 wherein said fluoro-polymer is selected from dipolymers of VF2/HFP, termpolymers of VF2/HFP/TFE, or copolymers of TFE/propylene and ethylene/TFE/AMVE.

7. The composition according to claim 1 wherein said fluoro-polymer comprises polytetraflouroethylene.

* * * * *

UNITED STATES PATENT AND TRADEMARK OFFICE

CERTIFICATE OF CORRECTION

PATENT NO. : 6,843,868 B1 
DATED : January 18, 2005
INVENTOR(S) : Christopher J. Fawls, Joel P. Fields and Kerry L. Wagaman It is certified that error appears in the above-identified patent and that said Letters Patent is hereby corrected as shown below:

Title page, Item [54] and Column 1, lines 1-3,
Title, should read -- PROPELLANTS AND EXPLOSIVES WITH FLUORO-ORGANIC ADDITIVES TO IMPROVE ENERGY RELEASE EFFICIENCY. --.

Signed and Sealed this

Sixth Day of September, 2005

JON W. DUDAS
*Director of the United States Patent and Trademark Office*